United States Patent [19]

Schefer

[11] Patent Number: 4,828,190

[45] Date of Patent: May 9, 1989

[54] PIVOT MECHANISM FOR A WINDER CHUCK

[75] Inventor: Kurt Schefer, Winterthur, Switzerland

[73] Assignee: Rieter Machine Works, Ltd., Winterthur, Switzerland

[21] Appl. No.: 126,925

[22] Filed: Nov. 30, 1987

[30] Foreign Application Priority Data

Dec. 2, 1986 [CH] Switzerland ..... 792/86

[51] Int. Cl.[4] ..... B65H 67/044; B65H 54/42

[52] U.S. Cl. ..... 242/18 A; 242/18 DD

[58] Field of Search ..... 242/18 DD, 18 A, 18 R, 242/25 A, 65, 66

[56] References Cited

U.S. PATENT DOCUMENTS

| | | | |
|---|---|---|---|
| 2,789,774 | 4/1957 | Petersen et al. | 242/18 A |
| 2,905,402 | 9/1959 | Foller et al. | 242/18 A |
| 3,076,614 | 2/1963 | Baer | 242/18 A |
| 3,310,247 | 3/1967 | Emery | 242/18 A |
| 3,334,827 | 8/1967 | Jackson | 242/18 A |
| 3,355,117 | 11/1967 | Gerhardt et al. | 242/18 A |
| 3,532,278 | 10/1970 | Sparling | 242/18 A |
| 3,708,133 | 1/1973 | McErlane et al. | 242/18 A |
| 4,451,006 | 5/1984 | Decuq et al. | 242/18 DD |

*Primary Examiner*—Stanley N. Gilreath
*Attorney, Agent, or Firm*—Kenyon & Kenyon

[57] ABSTRACT

A pivot mechanism for a chuck is to move the chuck between a rest position and a winding position, with the chuck contacting a contact roll in the latter position. The mechanism comprises two parts pivotable between open and closed positions relative to each other, one part carrying the chuck in a gripper. A piston and cylinder device is provided to determine the angular position of the other part relative to the rest position and the winding position.

12 Claims, 9 Drawing Sheets

322
350
310
370
313
312
342
332
334
338
336
314
328
344
320
326

PIVOT MECHANISM FOR A WINDER CHUCK

This invention relates to a pivoting mechanism for a winder chuck, and to a winding machine with such mechanism. The winding machine can be a machine for winding synthetic endless filaments.

Related applications and patents/State of the art (U.S. Pat. Nos. 4,497,450 and 4,524,918) shows a winding machine for continuous winding of a filament yarns of various types, e.g. textile threads, industrial and technical threads. The machine comprises two chucks each of which is supported by its own pivot arm for movement between a rest position and a winding position. A machine of this type is subsequently briefly described with reference to FIG. 1 of this application.

Further developments of this original, concept, can be found in the published U.S. Pat. Nos. 4,609,159 and 4,598,876. Still further modifications are shown in U.S. Pat. No. 4,641,793. Finally, still further variations have been described in co-pending U.S. patent application Ser. No. 941,418, filed Dec. 18, 1985 and Ser. No. 002,164, filed Jan. 22, 1986.

As subsequently explained in connection with FIG. 1, the arrangement according to U.S. Pat. No. 4,497,450 requires considerable space in the axial direction of each chuck.

An object of this invention is to reduce the amount of space required by a winding machine in the axial direction.

Briefly, the invention provides a pivot mechanism for a chuck in a winding machine which comprises two pivotable parts, a first means to determine the position of a first part relative to the second part and a second means to determine the position of the second part relative to a rest position and a winding position of the chuck which is supported on the first part for rotation about its own longitudinal axis.

The first and the second parts can be pivoted by the first means between closed and open positions relative to each other. The chuck can be held firmly against movement in its longitudinal direction on the first part and the first part can be movable in the longitudinal direction.

Figure 1:
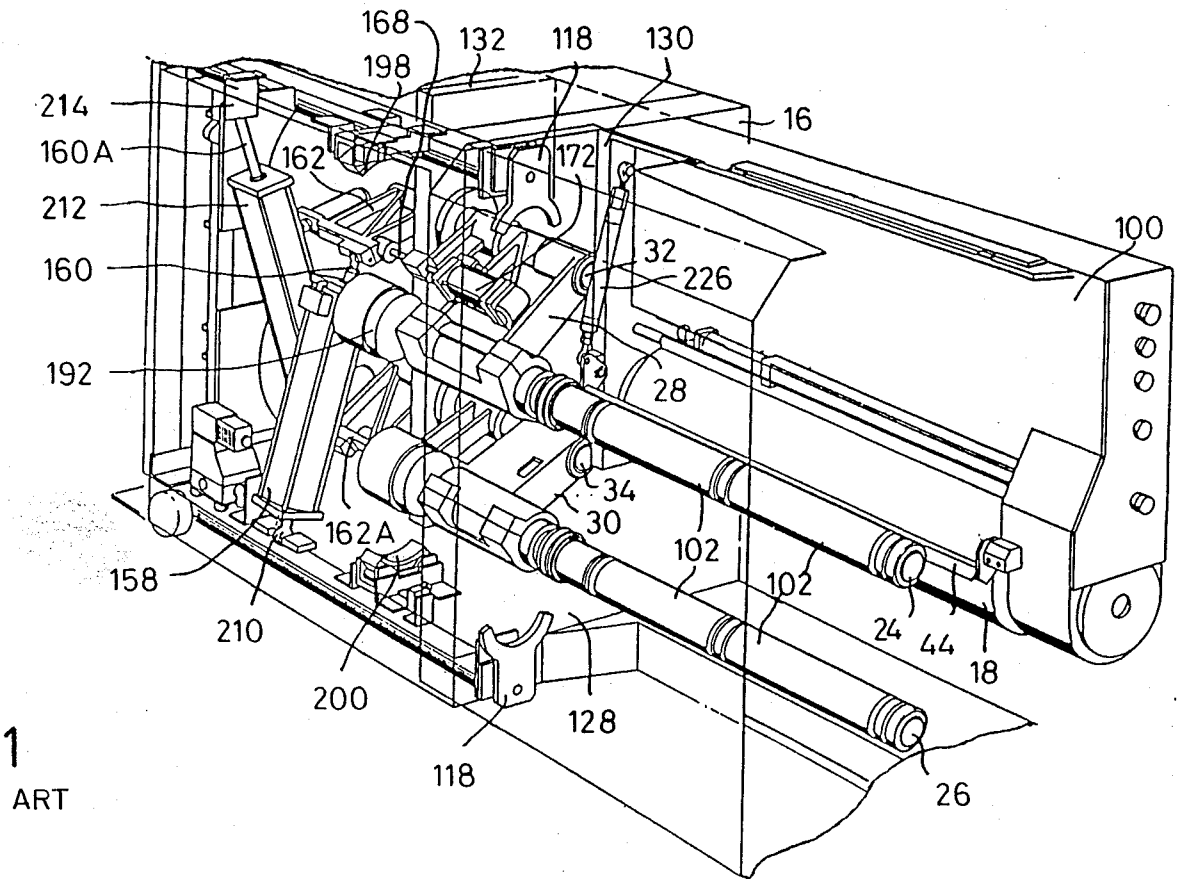
Fig. 1 PRIOR ART
Figure 2A:
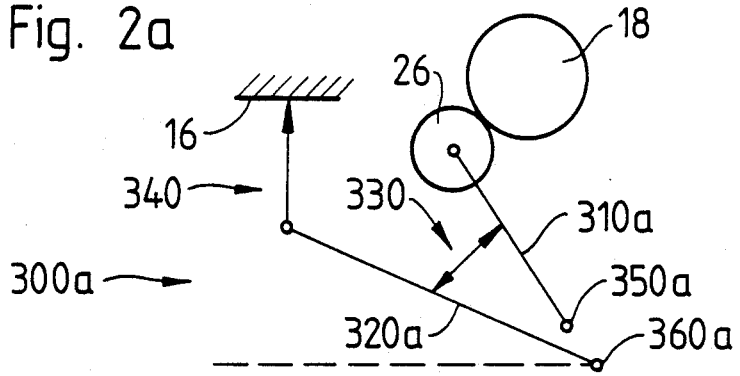
Figure 2B:
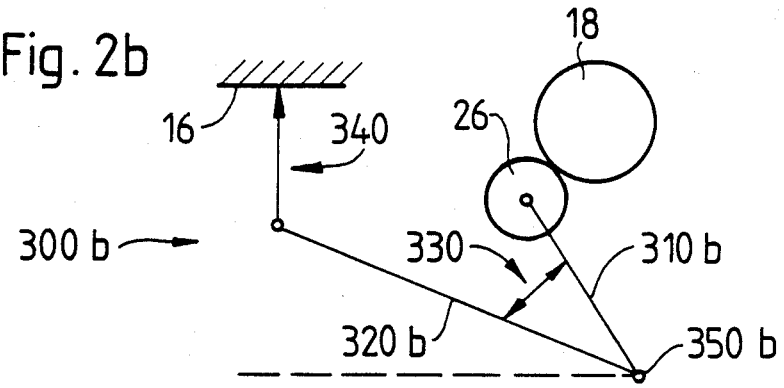
Figure 2C:
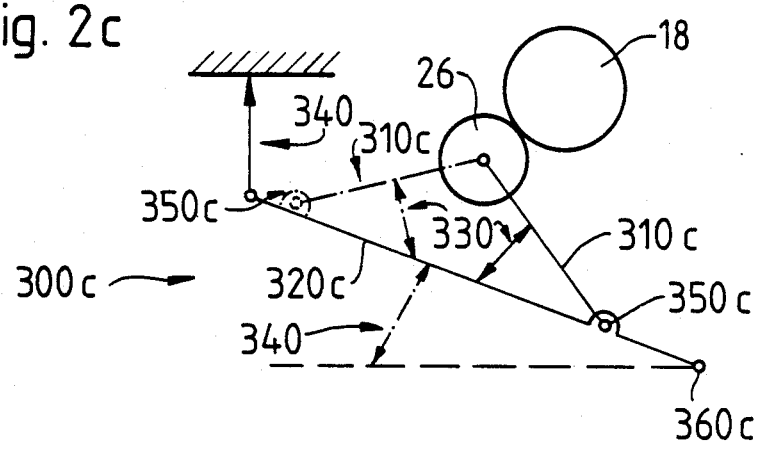
Figure 3:
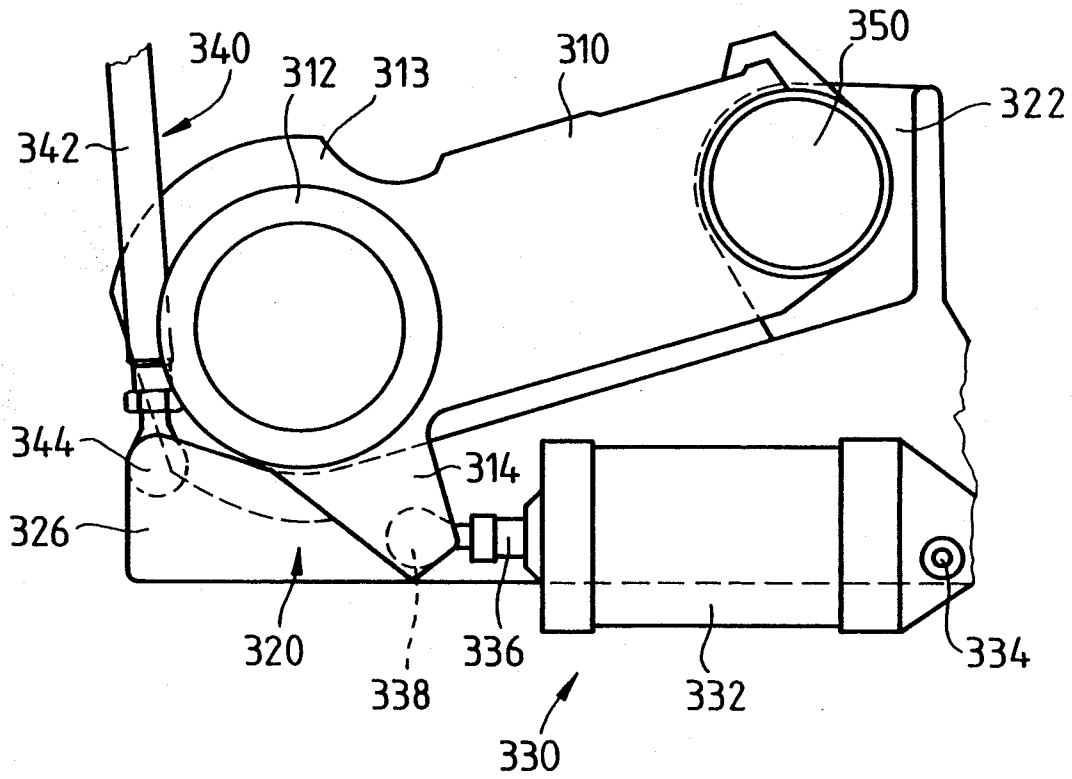
Figure 4:
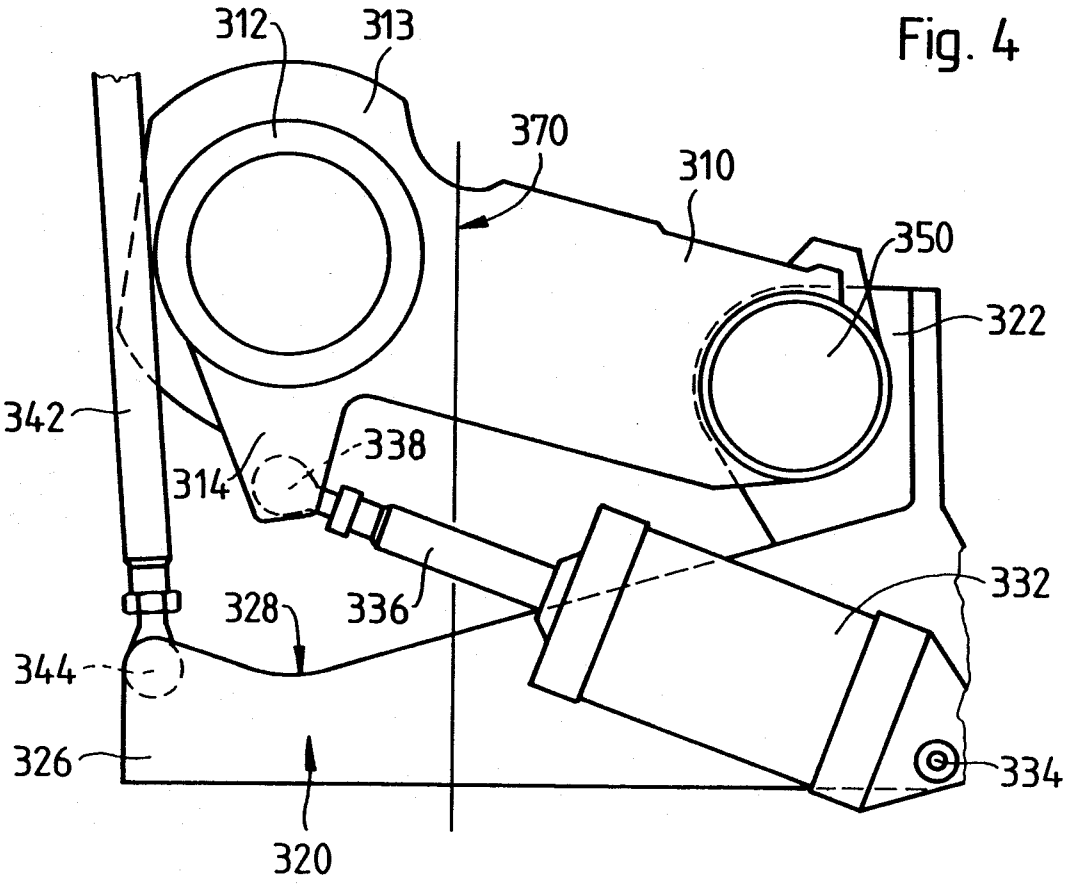
Figure 5:
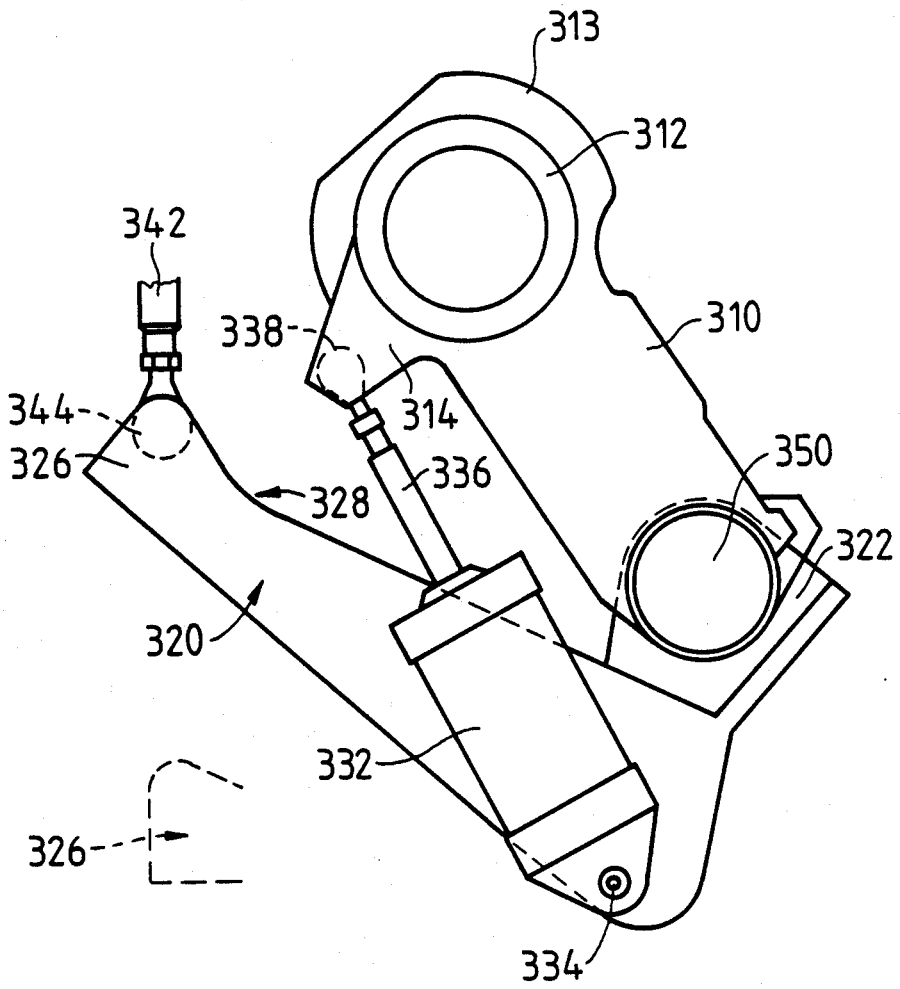
Figure 6:
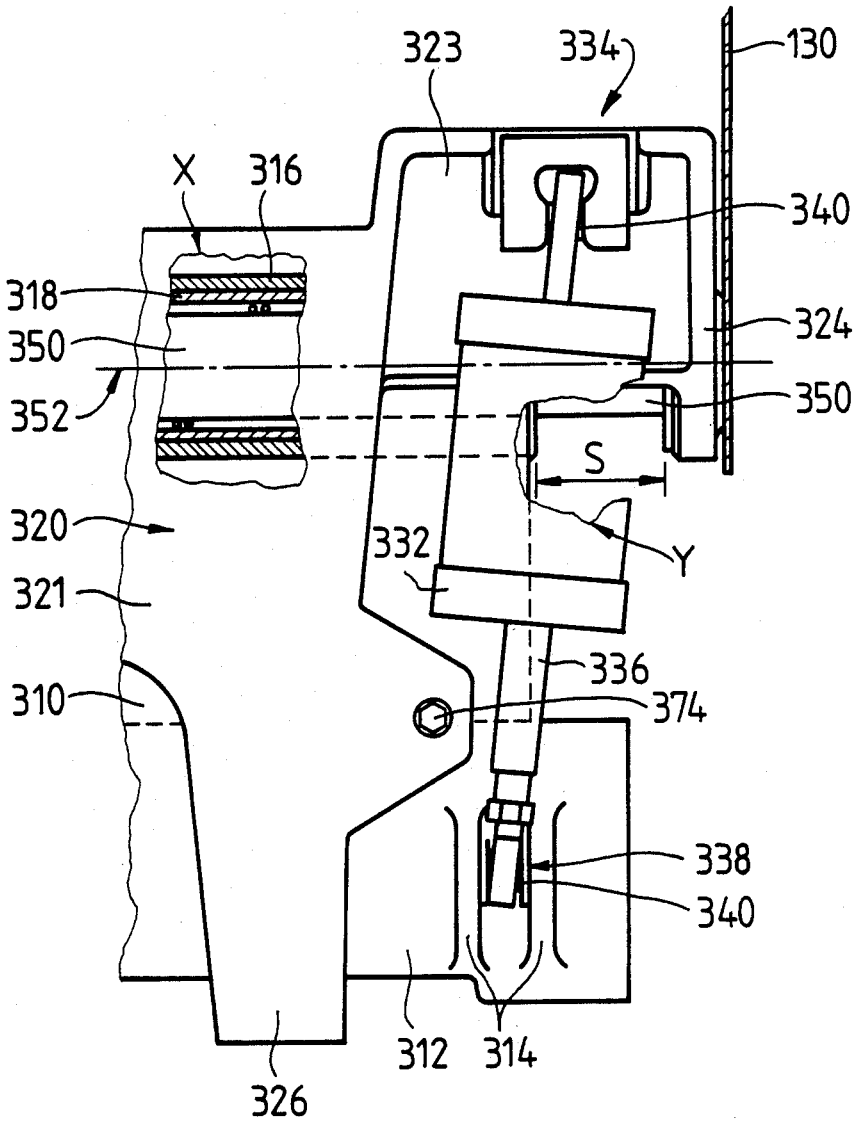
Figure 7:
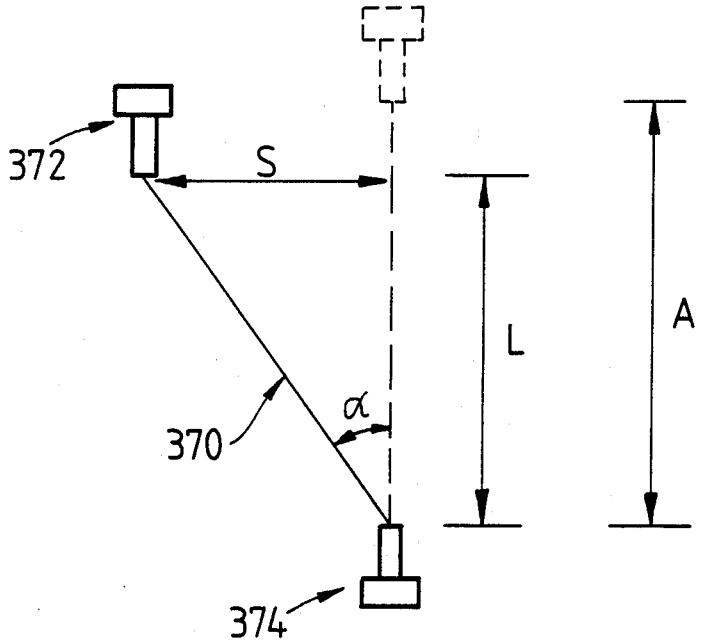

The invention will now be explained in further detail with reference to the accompanying drawings in which:

FIG. 1 is an isometric view of a winding machine in accordance with the prior art, FIGS. 2*a*, 2*b* and 2*c* show diagrammatic representations of various forms of a pivot mechanism in accordance with this invention for modifying the machine shown in FIG. 1, FIG. 3 shows a front view of a practical embodiment in accordance with the principle of FIG. 2*b* with the chuck still in the rest position, FIG. 4 shows a front view of the embodiment of FIG. 3 with the chuck in an intermediate position, FIG. 5 shows a further front view of the embodiment of FIG. 3 with the chuck in the winding position, FIG. 6 shows a partial view of a second pivot mechanism in accordance with the principle of FIG. 2*b*, viewed from above, with parts of the mechanism cut away to show other parts clearly, FIG. 7 is a diagram for explanation of a detail of the embodiment of FIGS. 3 to 6, and FIGS. 8 and 9 show a schematic representation of a further modification of the machine shown in FIG. 1.

The usage of reference, numeral in FIG. 1 corresponds to the usage in U.S. Pat. No. 4,497,450.

The winding machine of FIG. 1 comprises a housing 16 and a roller 18 that extends forwardly from the front face of the housing 16 and is supported for rotation about its own longitudinal axis by an outrider 100 mounted on the housing 16. Roller 18 can be formed as a driving friction roller or as a simple contact (tacho) roller.

The machine further comprises an upper chuck 24 and a lower chuck 26. Within the housing 16, chuck 24 is cantilever mounted on a swingarm 28 for rotation about its own longitudinal (chuck) axis, and the lower chuck 26 is similarly mounted on its own swingarm 30. For simplicity, it can be assumed that the swing axes of the arms 28, 30, the chuck axes and the longitudinal axis of the roller 18 are all parallel to each other. An advantageous, alternative arrangement is, however shown in U.S. Pat. No. 4,609,159.

For completeness the thread guide plate 44, the operating cylinder 226 for the guide 44 and the package ejector devices 118 are mentioned here since these elements also appear on the Figure. However, since they are irrelevant to the present invention they are not treated further in the following description which concentrates upon the pivot mechanisms provided in the housing 16.

The delivered threads (not shown) are wound up to form packages on tubes 102. Two tubes 102 are shown for each chuck 24, 26 by way of example; however, currently up to eight threads may be wound simultaneously side-by-side into packages on a single chuck. In general, the following description refers to winding of a single thread; this description is however valid for all simultaneously delivered threads.

The upper chuck 24 has a rest position wherein a brake disc 192 rotatable with the chuck engages a brake shoe 198. There is a corresponding rest position for the lower chuck 26 wherein the brake disc of this chuck engages a brake shoe 200. For winding of thread on the upper chuck, the latter can be moved out of its rest position by swinging of arm 28 in counterclockwise direction (FIG. 1) into the winding position wherein the tubes 102 carried by the chuck 24 come into contact with the roller 18. After completion of the packages on the upper chuck 24, this chuck can be returned to its rest position and the lower chuck 26 can be swung by pivoting of arm 30 in a clockwise direction to bring chuck 26 into a winding position against the roller 18 to take up the threads. FIG. 1 is unrealistic in that both chucks 24, 26 are shown in respective intermediate positions, which however enable representation of other elements.

The swingarm 28 is mounted on a shaft 32 that is itself rotatably carried in two carrier plates 130, 132. An extension (not seen in FIG. 1) of the shaft 32 beyond the plate 132 carries a connection element 162 which is connected by a joint with a rod 160 of a piston-and-cylinder unit 158. The cylinder of the unit 158 is connected by a further joint 210 with the baseplate 128 of the machine. By operation of the unit 158, the element 162 can be rotated about the longitudinal axis of the shaft 32, this rotation of element 162 being transferred to the swingarm 28 by a connecting rod 168. This rod 168 is connected to the piston (not visible in FIG. 1) of a piston-and-cylinder unit 172 and the cylinder of the unit 172 is fixedly mounted on the swingarm 28. By operation of the unit 172, the swingarm 28 is moved along its own chuck axis. Details and function of this arrangement are described in connection with FIGS. 8, 9, 10 and 14 of U.S. Pat. No. 4,497,450.

A substantially identical swing mechanism is provided for moving the lower chuck 26, only the shaft 34 carried by the plates 130, 132 and the piston-and-cylinder unit 212 being clearly visible in FIG. 1. In this case the cylinder unit 212 is jointed with an intermediate element 162A, and the rod 160A of the unit 212 is connected by a joint 214 with the housing 16. The space within the housing 16 can be divided into an imaginary front chamber between the plates 130, 132 and a rear chamber between the plate 132 and the rear wall of the housing 16. The front chamber contains the pivot arms 28, 30 and the corresponding parts of the chucks 24, 26, while the rear chamber contains the units 158, 212 and the intermediate elements 162, 162A. Each chuck 24, 26 can be extended from its swingarm 28, 30 towards the rear chamber, but cannot extend very far into the rear chamber without coming into contact with the unit 158, which must be avoided at all costs. The axial length of the machine could be reduced if the complete pivot mechanism could be disposed in the front chamber. An arrangement for this purpose will be subsequently described with reference to the further drawings, but the "scissors-principle" of this arrangement will first be described with reference to the diagrams in FIGS. 2*a*, 2*b* and 2*c*.

Each of the three FIGS. 2*a*, 2*b*, 2*c* shows a schematic representation of a respective pivot mechanism 300*a*, 300*b*, 300*c* for the lower chuck, which in these Figures is again indicated by the reference numeral 26 and is shown in each diagram in the winding position on the roller 18. Each pivot mechanism 300*a*, 300*b*, 300*c* comprises two parts which can be pivoted to closed and open positions, the first part 310*a*, 310*b*, 310*c* carrying the chuck at one end. The second part 320*a*, 320*b*, 320*c* is connected to the first part by a pivot joint 330 and with the housing 16 by a force-generating means 340. Each of the two parts is pivotably mounted in housing 16; the difference between the illustrated variants lies in the arrangement of the pivot axes for these parts, as will now be described.

In the following description of the diagrams of FIGS. 2*a*, 2*b* and 2*c*, the suffixes *a*, *b*, and *c* will only be added to the reference numerals when a specific variant is intended. Where no suffix is applied, the description applies equally to all variants.

In FIG. 2*a*, part 310*a* has its own pivot connection 350*a* directly with the housing 16 and the part 320*a* also has its own pivot connection 360*a* with the housing. In FIG. 2*b*, there is a common pivot connection 350*b* for both parts 310*b* and 320*b* with the housing 16, but the parts are independently mounted for pivoting around the axis of the pivot joint 350*b*. In FIG. 2*c*, part 320*c* has its own direct pivot connection 360*c* with the housing 16. Part 310*c* has no direct connection with the housing, but only a pivot joint 350*c* which is fixedly mounted on the part 320*c* and is movable with this part around the pivot axis of the joint 360*c*.

In FIG. 2*c*, another variant is indicated in dot-dash lines; in this modification, parts 310*c* and 320*c* extend in opposite directions from their respective pivot connections 350*c*, 360*c* .Further, the force-generating means 330 can be arranged underneath instead of on top of the part 320*c*, as indicated in dotted lines.

In all three variants 2*a* to 2*c* the pivot joint 330 is capable of determining the mutual angular positions of the parts 310, 320 within given limits by means of a pivotal movement of the first part 310 independently of the second part 320, i.e. to pivot these two parts between open and closed positions. A suitable means for this purpose will be described later in detail.

The force-generating means 340 is capable of swinging the second part 320 out of its starting position (indicated in dotted lines in each diagram) into the operating position (indicated in full lines in each diagram). The whole of this pivoting movement, to move the chuck 26 from its non-illustrated rest position into its illustrated winding position, is carried out in two stages. These two stages are however now performed by movement of separately movable pivot elements 310, 320.

In the non-illustrated rest position of the chuck 26, the second part 320 lies in its starting position (indicated in dotted lines) The device 330 is so conditioned that the first part 310 is closed up against the second part 320, with the angle between the parts being approximately zero (condition not illustrated in FIGS. 2*a*, 2*b* and 2*c*). During the first movement towards the winding position, the device 330 is operated to open up the parts 310, 320 relative to each other, the second part 320 remaining in its rest position. This first stage is completed when a predetermined maximum opening angle between the two parts has been reached. In this condition, also not shown, the chuck 26 is accelerated to its operating speed by a non-illustrated motor. This step serves as preparation for take-up of the thread during the second stage.

After the chuck 26 has reached its operating speed, the force-generating means 340 is operated to move the second part 320 from its start position into its operating position (shown in full lines) while the first pat 310 is held by the device 330 in the open position relative to the second part 320. This movement of the second part brings the chuck 26 from its intermediate or acceleration position into its illustrated winding position against the roller 18.

During package formation, chuck 26 must move from its illustrated winding position back towards its rest position (winding travel) to enable build-up of the package between the tubes 102 and the roller 18. During the winding travel the relative angular position of the parts 310, 320 remains unchanged.

However, during the winding travel the operation of the force-generating means 340 is continually adapted, e.g. as previously described with reference to FIGS. 16 and 17 of U.S. Pat. No. 4,497,450, to exert a controlled contact pressure between the package and the roller 18. After completion of the package (breaking off winding on the chuck 26), the chuck is returned to the rest position (by closing of the parts 310, 320 against each other and retraction of the part 320 into its starting position), the thread being taken up by the upper chuck 24 (FIG. 1) to continue winding.

FIGS. 2*a*, 2*b* and 2*c* only the lower chuck 26 and the corresponding pivot mechanism 300. It will however be clear that the upper chuck 24 (FIG. 1) can be carried and moved by a similar pivot mechanism arranged mirror-image fashion relative to the first.

Although FIGS. 3 to 7 show a practical embodiment, individual elements have been simplified and therefore only schematically illustrated, since certain details (e.g. the exact form of the castings) are irrelevant to the invention. In the following description, the function will be emphasized rather than the detailed construction. FIGS. 3 to 5 show a pivot mechanism for the lower chuck, while FIG. 6 shows the upper mechanism. Since the parts are identical in their function, they are identified with the same reference numerals in the upper and lower mechanisms.

Reference numeral 350 indicates a supporting shaft which extends between two carrier plates (not shown in FIGS. 3 to 5) similar to the shaft 34 in FIG. 1. Shaft 350 is rotatably supported in each of the plates. Two parts are individually, rotatably mounted on this shaft 350, namely an arm 310 and a lever 320. At its free end, the arm 310 has a gripping device 312 with which it holds the lower chuck 26 (FIG. 1, not shown in FIGS. 3 to 5) fast against movement in the longitudinal direction of the chuck axis. A bearing device in the chuck itself enables rotation of the tube-carrying portion of the chuck around the chuck axis during package build.

The lever 320 is mounted on the shaft 350 by two lugs 322, 324 (FIG. 6). The arm 310 is mounted on the shaft 350 between these two lugs 322,324 in a manner that will be subsequently described with reference to FIG. 6. For the present, the description concentrates on the pivotal movements of the parts 310, 320 in accordance with FIGS. 3, 4 and 5, during which each part rotates about the longitudinal axis of the shaft 350.

The means 330 (FIG. 3) to determine the mutual angular position of the parts 310, 320 comprises a pneumatic cylinder 332 a connection 334 between the cylinder 332 and the lever 320, a connecting rod 336, which is connected with the piston (not shown) of the cylinder 332, and a connection 338 between the rod 336 and a projection 314 on the gripper 312 of the arm 310. The connections 334, 338 will be described subsequently in connection with FIG. 6. For the present it suffices to say that each connection permits rotation of the cylinder 332 in a clockwise or anti-clockwise direction with reference to FIGS. 3 to 5.

The means 340 (FIG. 3) to determine the position of the lever 320 relative to the rest position and the winding position of the chuck comprises a piston rod 342, a rotational connection 344 between the piston rod 342 and an end portion 326 at the free end of the lever 320, a cylinder (not shown) to operate the rod 342 and a joint (not shown) between he cylinder and the housing 16.

The last-mentioned, non-illustrated cylinder corresponds substantially to the cylinder 212 in FIG. 1, but is no longer located at the rear but in the front part of the housing 16, as are the other parts shown in FIGS. 3 to 6.

FIG. 3 shows the positions of the parts when the chuck 26 is in its rest position, which is identical with the rest position of the chuck 26 shown in FIG. 1. In this condition, the cylinder of the means 340 is not pressurized so that the connection 344 lies at the lower limit of its predetermined path, the lever 320 extending horizontally from its connection with the shaft 350. Cylinder 332 is also vented so that rod 336 is in its withdrawn position relative to the cylinder 332. The arm 310 is therefore pivoted shut against lever 320, the gripper 312 resting against a trough-shaped surface 328 (FIGS. 4 and 5) of the lever 320.

FIG. 4 shows the mutual positions of the parts 310, 320 when the chuck held by the gripper 312 lies in an intermediate position between the rest and winding positions. This intermediate position is reached by pressurizing the cylinder 332 with air from a suitable non-illustrated source to extend rod 336 from the cylinder. In FIG. 3 rod 336 does not extend parallel to arm 310 but encloses an acute angle therewith so that the pressurization of cylinder 332 exerts a rotational moment on the arm 310 to rotate the arm clockwise about the axis of shaft 350. The arm 310 is freely rotatable on the shaft 350 so that the rotational movement can continue until the rod 336 has been fully extended from cylinder 332. An alternative arrangement, which enables a temporary limit to this movement for a certain purpose, will be described later with reference to FIGS. 6 and 7.

During the movement of the arm 310 to bring the chuck into its intermediate position, the cylinder of the means 340 remains unpressurized. The lever 320 therefore remains in its horizontal position while the arm 310 is pivoted open relative to the lever 320 by operation of the means 330. In the intermediate position shown in FIG. 4, chuck 26 can be accelerated to its operating speed or higher so that it is ready to take up the thread to be wound as soon as winding of the thread on the upper chuck 24 (FIG. 1) is broken off. In order to take up the thread, chuck 26 must then be moved towards its previously mentioned winding position; this is effected by operation of the means 340 as can be seen from FIG. 5.

The original horizontal position of lever 320 according to FIGS. 3 and 4 is indicated again in FIG. 5 by a dotted line representation of the end portion 326 of the lever. However, in order to bring the chuck from its intermediate position (FIG. 4) into its winding position (FIG. 5), the cylinder of the means 340 is pressurized so that the rod 342 is withdrawn into the cylinder and the lever 320 is correspondingly rotated clockwise about the axis of the shaft 350. During this rotation of the lever 320, the cylinder 332 remains pressurized and the opened up condition of the parts 310, 320 is therefore retained whereby the rotational movement of the lever 320 is transferred by the means 330 to the arm 310. The required rotation of the chuck 26 from its rest position towards its winding position is effected by operation of the means 330, 340 in a predetermined sequence. In a machine of the type shown in FIG. 1 an axial movement of the chuck i.e. along its own chuck axis, is also necessary, during the rotational movement from the rest position into the winding position. The performance of this additional axial movement will now be described with reference to FIG. 6.

The pivot mechanism partly shown in FIG. 6 is not that of the lower chuck 26 but that of the upper chuck 24 (FIG. 1). The upper pivot mechanism is arranged mirror-image fashion relative to the lower mechanism, which implies that the cylinder of the means 340 (FIG. 3) for the upper mechanism does not correspond to the cylinder 212 in FIG. 1 but to the cylinder 158, i.e. it is not connected to the top plate of the housing 16 but to the base plate 128 (FIG. 1). Accordingly, the two stages of movement of the upper mechanism are not effected by lifting but by lowering of the relevant parts.

The form of the upper lever 320 must be made slightly different from the form of the lower lever so that the cylinders for operating these levers can be arranged next to each other in the longitudinal direction of the chuck. Each lever therefore has two wings 321, 323 each of which carries a lug 322,324 respectively. The lengths of these wings in the longitudinal direction of the shaft axis 352 are different for the upper and lower mechanisms. However, this physical difference does not affect the function of the individual mechanisms.

FIG. 6 shows the front end of the upper pivot mechanism adjacent the carrier plate 130, with the mechanism in a position corresponding to the intermediate position of the chuck 24. In the detail X, the lever 320 and arm 310 have both been partly cut away to show the shaft 350, and in the detail Y a part of the cylinder 332 has been cut away for the same purpose. The detail X shows that the arm 310 is mounted on the shaft 350 by means of a sleeve 316 with a ball bearing 318 enabling the free movement of the arm 310 in the longitudinal direction of the shaft 350.

During the pivot movement of the whole mechanism to bring the chuck from its intermediate position against the roller 18, the arm 310 stays in the retracted position shown in FIG. 6 until the thread to be wound has been taken up by the chuck. Then, the arm 310 is moved forward until the spacing S disappears, i.e. until the front end of the sleeve 316 engages the lug 324. This forward movement of the arm 310 is effected by a nonillustrated piston-and-cylinder unit corresponding to the unit 172 in FIG. 1, the cylinder of this unit being connected with the lug 322 (FIGS. 3 to 5) and the rod being connected with the arm 310.

The purpose of this forward movement of the arm 310 will not be described here, since it is set out in detail in U.S. Pat. No. 4,497,450. It will however be clear from FIG. 6 that this movement of the arm 310 requires an adaptation of the position of the cylinder 332 relative to the lever 320 and the arm 310. The connections 334 and 338 therefore each comprise a joint element 340 which permits limited universal movement of the cylinder 332 and the rod 336.

In a preferred embodiment of the invention, the chuck is not immediately brought into its winding position, i.e. into contact with the roller 18, by operation of the means 340 (FIG. 3). It is normally advantageous to rotate the chuck about its own axis with a certain "overspeed" at the time of take up of the threads. This means that the tangential speed of the periphery of the tubes 102 is slightly higher than the tangential speed at the periphery of the roller 18 at the take up. In order to enable this without difficulty, at the time of take up a tiny gap should be left free between the roller 18 and the tubes 102 carried by the chuck. Immediately after take up of the threads, the chuck must be pivoted further around the axis 352 (FIG. 6) of the shaft 350 to bring the tubes, 102 into contact with the roller. In U.S. Pat. No. 4,497,450 it is suggested that an abutment should be provided to temporarily limit the movement of the swingarm for this purpose. The new mechanism has been provided with an alternative device for this purpose, as will now be described with reference to FIGS. 4, 6 and 7.

In accordance with the new proposal, the parts 310,320 are joined by a flexible element, e.g. a short chain. This element is indicated schematically in FIG. 4 and also in FIG. 7 by the line 370. The element 370 is anchored at one end to the arm 310 by a joint 372 (FIG. 7) and at its other end with the lever 320 by a similar connection 374. The arrangement is so selected that when the arm 310 is in its front position, i.e. the sleeve 316 (FIG. 6) contacts the lug 324, the element 370 extends vertically between the lever 320 and the arm 310, as indicated in FIG. 7 in dotted lines. As the arm 310 is moved into its retracted position (FIG. 6), the element 370 is adjusted from its vertical into an inclined position represented with full lines in FIG. 7. In its vertical position the element 370 enables a spacing A between the joint 372 carried by the arm 310 and the joint 374 carried by the lever 320. When the element 370 adopts an inclined position, the possible spacing is reduced to L (FIG. 7). The element 370 therefore forms a limiting means which blocks outward movement of the rod 336 from the cylinder 332 before it reaches the end of its stroke, and correspondingly limits the relative angular position of the parts 310, 320.

In this variant, in distinction to the previous description of FIG. 4, the parts 310, 320 are not pivoted completely open relative to each other when the chuck is in its intermediate position, since at this time the arm 310 is retracted (FIG. 6) and the opening movement is limited by the element 370. The parts 310, 320 remain in this partly-opened angular position until take up of the threads. If then the arm 310 is moved forward and the element 370 is thereby moved back into its vertical position, the cylinder 332 forces the rod 336 further outwards so that the tubes 102 are brought into contact with the roller 18.

During build up of the package, the chuck must be slowly moved back from this winding position to enable increase in the package radius between each tube 102 and the roller 18 while contact is maintained between the package and the roller. During this "winding travel", the condition of the means 330, and hence the angular disposition of the parts 310, 320, remains unchanged. On the other hand, the condition of the means 340 is continually adapted to the changing winding conditions—not simply with reference to the position of the lever 320 relative to the roller, but also with reference to the contact pressure between the package and the roller 18.

After completion of the package, the lever 320 is first moved back into its starting position whereupon the parts 310, 320 are pivoted shut by venting the cylinder 332 to return the chuck to its rest position. Suitable means (not shown) can be provided to store the flexible element 370 cleanly when the parts 310, 320 are shut, e.g. a resilient means can bias the element 370 so that it adopts a predetermined folded condition when the parts 310, 320 are pivoted shut.

An intermediate support (in FIG. 1, the carrier plate 132) within the housing 16 is no longer required. The chucks can now extend much further from the swingarms 310 rearwardly into the housing 16, thereby enabling use of a much larger drive motor at the rear end of each chuck. The new design is therefore especially useful for a winder with so-called spindle drive in which the drive forces are generated at least for the greater part from the chuck motor and not from the roller 18.

The rear part of the chamber between the plates 130, 132 can also be held substantially free of other components. If the roller 18 is driven by a shaft (not shown) extending into the housing 16, this shaft can be supported in the two plates 130, 132 and the drive motor can be secured to the rear face of the rear plate 132.

The brake devices 198,200 (FIG. 1) are not suitable for cooperation with the new mechanism. An alternative solution, which enables mounting of the brakes on the grippers 312, will now be described with reference to FIGS. 8 and 9.

The front part of the gripper 312, as viewed in FIG. 6, comprises gripping shoes (not shown) which encircle and hold firmly a non-rotatable part of the chuck. The rear part of the gripper has a flange 313 (FIGS. 3 to 5) on which a housing 380 (FIGS. 8 and 9) for the brake device is secured. A rotatable part 25 of the chuck projects through the gripper 312 and carries a brake disc 382 located within the brake housing 380.

The housing 380 has an opening 384 (FIG. 9) through which a drive shaft (not shown) can extend to the rotatable part of the chuck. The drive motor (acceleration motor or main drive motor) can be mounted on the housing 380 (not shown).

Housing 380 is provided with a short, annular, inwardly projecting extension 386 at the opening 384. Brake device 390 is so mounted on this extension by a bearing 388 that the whole device 390 can perform limited rotational movement around the chuck axis 20. The purpose of this movement will become clear from the subsequent description.

Figure 8:
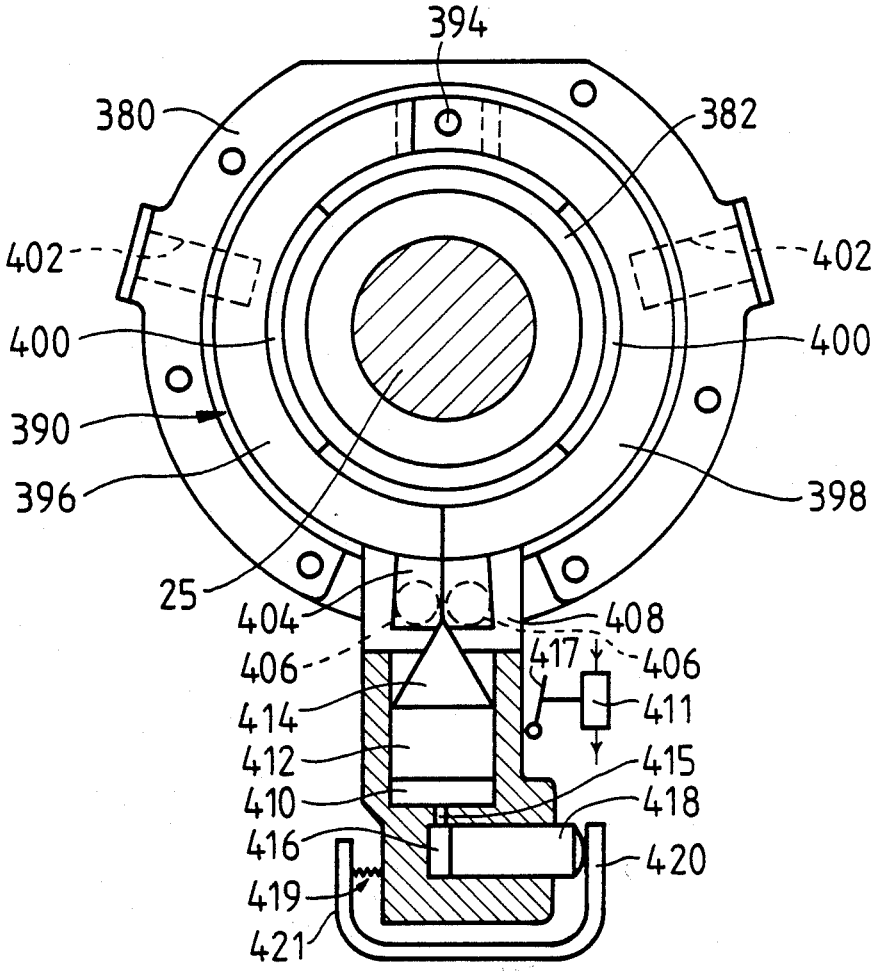

Device 390 comprises a carrier ring 392 rotatably supported by bearing 388 on the extension 386. A bolt 394 is threaded into the ring 392, and extends in the axial direction towards the gripper 312. Two brake shoes 396, 398 are rotatably suspended from the free portion of the bolt 394, each shoe 396, 398 being substantially semicircular and extending around the brake disc 382. At its inner end each brake shoe 396, 298 has a lining 400 which can be brought into contact with the disc 382 by rotation of each shoe around the longitudinal axis of the bolt 394. The brake shoes are biased in this direction by respective means such as springs 402 (FIG. 8).

Means are also connected to the carrier ring 392 for biasing the brake shoes 396, 398 radially outwardly with pneumatic means to actuate the same to release the brake disc 382. For example at its end remote from the bolt 394, each shoe 396, 398 has a pin 404 with a roller 406 mounted thereon. When the lining 400 engages the disc 382 the rollers 406 are located close to each other with a predetermined spacing (FIG. 8).

Figure 9:
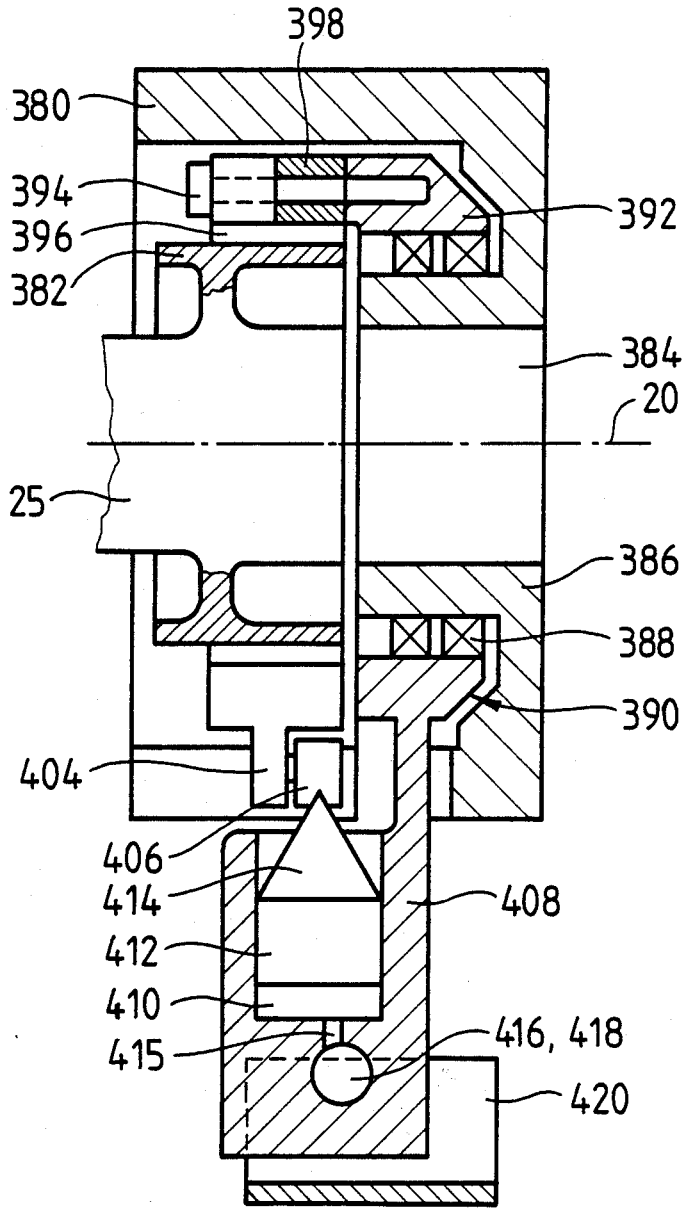

Ring 390 also has an outrider 408 extending substantially parallel to the arm 310 towards the shaft 350 (FIGS. 3 to 5). The outrider 408 comprises a radially extending chamber 410 which opens radially inwardly towards the roller 406. A piston 412 with a conical end portion 414 moves in this chamber 410, as shown in FIGS. 8 and 9, the apex of the conical portion 414 projects between the rollers 406 without contacting them. When the chamber 410 is pressurized from its outer end, the conical portion 414 is forced radially inwardly between the rollers 406. The forces exerted by pressure air are adequate to overcome the bias applied by the springs 402 so that the shoes rotate around the bolts 394 and release the disc 382.

The outer end portion of the outrider 408 comprises a chamber 416, extending transversely to the outrider 408 and the chuck axis 20, and a piston 418. The chamber 416 is open at one at one end (to the right in FIG. 8), and the piston projects beyond the open end of the chamber. The free end of the piston 418 contacts one leg 420 of a U-shaped abutment which can be carried by the housing 16 or the arm 310 (not shown). In any event, the abutment is not rotatable around the axis of the check 20. A spring is arranged between the outrider 408 and the other leg 421 of the abutment 420 and presses the outrider 408 towards the leg 420.

Chamber 416 is connected with chamber 410 via an opening 415 so that both are pressurized and vented simultaneously. If chamber 416 is pressurized, the outrider 408 rotates clockwise (as seen in FIG. 8) against the bias exerted by spring 419. A feeler 417 responds to this rotation and blocks a control valve of the pneumatic means which controls feed to pressure air from a suitable source (not shown) to a tube-gripping system (not shown) in the chuck. Blockage of the valve 411 prevents release of the gripping system.

If now chamber 410 and chamber 416 are vented and the brake linings are then brought into contact with the rotating disc 382 by the springs 402, this disc exerts a rotational moment on the device 390. Since the device 390 is freely rotatable on the projection 386, the moment is transferred to the outrider 408, which causes rotation of the outrider in a clockwise direction (FIG. 8) against the bias of the spring 419. Only when the chuck comes to a standstill, so that the moment exerted by the chuck on the outrider falls away, can the spring 419 rotate the outrider anticlockwise (FIG. 8) upon further venting of the chamber 410 and 416. The feeler 417 reacts to this by canceling the blocking of the valve 411. The tube gripping system in the chuck is thereby released.

The invention is not limited to details of the illustrated example. The axial movement of the chuck is not an essential feature. If, however, this movement does not take place, additional thread guides must be provided to transfer the threads cleanly from one chuck to the other during the change over phase. The new pivot mechanism can also be used if only one chuck is to be moved, although then of course continual winding of the thread is not possible. The described sequence of operations is not essential. If, for example, the chuck can already be accelerated to operating speed while in its rest position, then an intermediate position is unnecessary. The means 330,340 can then be operated simultaneously, and the one or the other or both can be exploited to generate the contact pressure.

What is claimed:

1. In a winding machine, the combination comprising a housing;

a pair of chucks mounted in said housing and extending therefrom in cantilevered manner into a common operating zone;

a pair of pivot mechanisms disposed in said housing in vertically spaced relation, each said pivot mechanism being connected with a respective chuck for moving said respective chuck between a rest position and a winding position and including a pivotable arm having said respective chuck rotatably mounted thereon on a longitudinal axis, a pivotable lever, first means connecting said arm with said lever for pivoting said arm relative to said lever to define an angular relation therebetween and second means for pivoting said lever to move said respective chuck between said positions.

2. The combination as set forth in claim wherein said arm is pivotable between an open position and a closed position relative to said lever.

3. The combination as set forth in claim 1 which further comprises a brake means on said arm for braking a rotating chuck thereon to a stop.

4. In a winding machine, the combination comprising a chuck; and a pivot mechanism for moving said chuck between a rest position and a winding position, said mechanism including an arm mounted on a longitudinal axis for longitudinal movement thereof and having said chuck rotatably mounted thereon about said axis, a pivotally mounted lever, first means connecting said arm with said lever for pivoting said arm relative to said lever and second means for pivoting said lever to move said chuck between said positions.

5. The combination as set forth in claim 4 which further comprises third means for limiting movement of said arm away from said lever, whereby the maximum angle of opening between said are and said lever is dependent upon the position of said arm relative to aid lever along said longitudinal axis.

6. A pivot mechanism for a chuck comprising a shaft;

an arm rotatably and slidably mounted on said shaft to move longitudinally of said shaft, said arm having a chuck rotatably mounted thereon at one end for movement of said chuck towards and away from a roller;

a lever pivotally mounted at one end about a transverse pivot axis;

a pivot joint connected to and between said arm and said lever to move said arm and said lever relative to each other between an open position and a closed position, said pivot joint including a universal connection with said lever and a universal connection with said arm; and a force-generating means connected to said second part for pivoting said second part about said axis thereof between a starting position and an operating position whereby said chuck is movable between a rest position corresponding to said starting position and said closed position and a winding position corresponding to said operating position and said open position.

7. A pivot mechanism as set forth in claim 6 wherein said pivot axis of said arm and said lever are in spaced relation to each other.

8. A pivot mechanism as set forth in claim 6 wherein said arm and said lever are pivotally mounted on a common pivot axis.

9. A pivot mechanism as set forth in claim 6 wherein said arm is pivotally mounted on said lever.

10. A pivot mechanism as set forth in claim 6 wherein said has a gripping device at said one end to hold said chuck thereon.

11. A pivot mechanism as set forth in claim 6 wherein said pivot joint includes a chain connected to and between said arm and said lever.

12. A pivot mechanism for a chuck comprising a first part having a chuck rotatably mounted thereon at one end and being pivotally mounted about a pivot axis transverse to said first part at an opposite end for movement of said chuck towards and away from a roller;

a second part pivotally mounted at one end about said pivot axis;

a pivot joint connected to and between said parts to move said parts relative to each other between an open position and a closed position; and a force-generating means connected to said second part for pivoting said second part about said axis thereof between a starting position and an operating position whereby said chuck is movable between a rest position corresponding to said starting position and said closed position and a winding position corresponding to said operating position and said open position.

* * * * *

UNITED STATES PATENT AND TRADEMARK OFFICE

CERTIFICATE OF CORRECTION

PATENT NO. : 4,828,190

DATED : May 9, 1989

INVENTOR(S) : KURT SCHEFER

It is certified that error appears in the above-identified patent and that said Letters Patent is hereby corrected as shown below:

Column 2, line 1 "reference, numeral" should be -reference numerals-
Column 4, line 21 "first movement" should be -first stage of movement-
Column 4, line 34 "pat" should be -part-
Column 5, line 43 "he: should be -the-
Column 7, line 17 "nonil-" should be -non-il-
Column 9, line 20 "298" should be -398-
Column 9, line 50 "at one at one" should be -at one-
Column 9, line 56 "check" should be -chuck-
Column 10, line 49 "claim" should be -claim 1-
Column 11, line 2 "are" should be -arm-
Column 11, line 3 "aid" should be -said-
Column 12, line 7 "said" (first occurrence) should be -said arm-

Signed and Sealed this

Twenty-seventh Day of February, 1990

*Attest:*

JEFFREY M. SAMUELS

*Attesting Officer* *Acting Commissioner of Patents and Trademarks*